US008540239B2

(12) United States Patent
Kaiga et al.

(10) Patent No.: US 8,540,239 B2
(45) Date of Patent: Sep. 24, 2013

(54) SHEET CONVEYING APPARATUS AND IMAGE FORMING APPARATUS

(75) Inventors: Miho Kaiga, Suntou-gun (JP); Shinkichi Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 13/165,959

(22) Filed: Jun. 22, 2011

(65) Prior Publication Data

US 2012/0003024 A1 Jan. 5, 2012

(30) Foreign Application Priority Data

Jun. 30, 2010 (JP) ..... 2010-150246
Mar. 29, 2011 (JP) ..... 2011-071782

(51) Int. Cl.
*B65H 7/02* (2006.01)

(52) U.S. Cl.
USPC ..... 271/227; 271/228; 271/261; 271/265.03

(58) Field of Classification Search
USPC ..... 271/227, 228, 261, 265.03
See application file for complete search history.

(56) References Cited

U.S. PATENT DOCUMENTS 5,149,080 A 9/1992 Yamamoto
5,348,287 A 9/1994 Yamamoto et al.
5,588,758 A 12/1996 Yamamoto
5,642,949 A 7/1997 Yamamoto
6,342,909 B1 1/2002 Joichi et al.
6,564,966 B2 5/2003 Kaiga et al.
8,146,907 B2 * 4/2012 Kato et al. ..... 270/58.07
2009/0057993 A1 * 3/2009 Zancanaro ..... 271/227
2009/0315246 A1 12/2009 Nishimura et al.
2010/0052248 A1 * 3/2010 Fushimi ..... 271/227
2010/0117289 A1 5/2010 Takahashi et al.
2011/0089623 A1 * 4/2011 Kato et al. ..... 270/58.07
2011/0206392 A1 8/2011 Hiratsuka et al.
2011/0277604 A1 * 11/2011 Yahata et al. ..... 83/13
2012/0152077 A1 * 6/2012 Kato et al. ..... 83/368

FOREIGN PATENT DOCUMENTS

JP 62-040475 2/1987
JP 03-211149 A 9/1991
JP 5-132193 5/1993
JP 2000-335010 12/2000
JP 2007-091369 A 4/2007

* cited by examiner

*Primary Examiner* — David H Bollinger
(74) *Attorney, Agent, or Firm* — Fitzpatrick, Cella, Harper & Scinto

(57) ABSTRACT

A sheet conveying apparatus which detects an end part position of a sheet in a sheet width direction orthogonal to a conveying direction of the sheet conveyed on a sheet conveying path, comprising a plurality of sensor portions; a holding portion which holds the plurality of sensor portions; a plurality of aperture stops which is disposed between the light emitting portion and the light receiving portions and which is provided on the holding portion; and a driving portion which causes a movement of the holding portion in the sheet width direction.

20 Claims, 9 Drawing Sheets

SHEET CONVEYING APPARATUS AND IMAGE FORMING APPARATUS

BACKGROUND OF THE INVENTION

1. Field of the Invention

The present invention relates to a sheet conveying apparatus which has a position detecting apparatus which detects an end part position of a sheet, and an image forming apparatus having this sheet conveying apparatus.

2. Description of the Related Art

A conventional image forming apparatus pulls out sheets on which images are formed, one by one from a sheet cassette by means of feeding rollers to feed to the image forming portion. Therefore, there are cases where sheets to be fed (skewed and fed) are conveyed in an inclined state with respect to a sheet conveying direction due to the difference between outer diameters of feeding rollers or the difference between feeding speeds produced by friction of feeding rollers, or the influence of the sliding resistance between sheets and a conveying guide which conveys sheets.

When sheets are skewed and fed, if, for example, a toner image on a photosensitive drum is transferred onto a sheet, the toner image is printed in a state where the image is inclined with respect to the sheet. Hence, the image forming apparatus has a shutter member in a pair of registration rollers to correct skew feeding of sheets (hereinafter, also "skew feeding correction"), and aligns the front end of a sheet to be adjusted in a direction orthogonal to the conveying direction to convey to the image forming portion.

However, with the above skew feeding which is performed by having the front end of a sheet hit the shutter member, although it is possible to perform skew feeding correction of conveying sheets virtually parallel to the sheet conveying direction, it is not possible to correct the position of the sheet misaligned in a direction orthogonal to the sheet conveying direction.

Further, when, for example, duplex printing of sheets is performed, an image is formed on the first face, then the sheet is reversed and an image is formed on the second face, and therefore a conveying route for an image to be formed on the second face is longer than the first face. Therefore, the second face is susceptible to the influence of various rollers and conveying guide. By this means, sheets are likely to be skewed and fed, or misaligned. Further, sheets on which toner images are fixed in a fixing portion are contracted due to heat and pressure of the fixing portion, and is smaller upon printing of the second face than upon printing of the first face. By this means, there are cases where the end part position of a sheet is changed in a direction orthogonal to the conveying direction.

By contrast with this, a position detecting apparatus is discussed which corrects position misalignment of sheets by detecting an end part position of a sheet in a direction orthogonal to the conveying direction (Japanese Patent Laid-Open No. 2000-335010 and FIG. 1 of Japanese Patent Laid-Open No. 62-40475). With the position detecting apparatus discussed in Japanese Patent Laid-Open No. 2000-335010, line sensors are arranged in a line to detect end part positions of the minimum size to maximum size of sheets to be conveyed, and detect a side edge portion of a sheet based on a light blocked state by irradiating one face of the sheet with light. According to Japanese Patent Laid-Open No. 62-40475, a plurality of sensors is closely arranged in a width direction to detect an end part position of a sheet.

However, the position detecting apparatus discussed in Japanese Patent Laid-Open No. 2000-335010 detects side edge portions of conveyable sheets of all sizes, and therefore requires line sensors having a length which enables detection of end portions of all sizes. Therefore, there is a problem that cost of sensors becomes high, and, as a result, cost of the entire apparatus becomes high. According to Japanese Patent Laid-Open No. 62-40475, while a detecting portion which is provided with a plurality of sensors aligned in a width direction is moved according to a sheet size and therefore the number of sensors is comparatively a little, more sensors are necessary to precisely detect positions of sheets, and therefore cost increases.

By contrast with this, a position detecting apparatus is discussed which detects an end part position in a sheet width direction orthogonal to a sheet conveying direction using a photointerrupter in which light emitting elements and light receiving elements are arranged to oppose to each other (Japanese Patent Laid-Open No. 5-132193). The position detecting apparatus discussed in Japanese Patent Laid-Open No. 5-132193, moves a photointerrupter such that a sheet end part crosses between pairs of light emitting elements and light receiving elements arranged to oppose to each other, and detects an end part position of a sheet based on the distance from a reference position to an optical path blocking position.

However, the position detecting apparatus discussed in Japanese Patent Laid-Open No. 5-132193 detects a position by means of pairs of light emitting elements and light receiving elements, and needs to increase the moving distance of the photointerrupter to measure sheet end parts of a plurality of sheet sizes. Further, to secure the moving distance of the photointerrupter, for example, a moving mechanism needs to be made larger. Therefore, the apparatus becomes larger.

SUMMARY OF THE INVENTION

The present invention provides a sheet conveying apparatus which has a position detecting apparatus which can precisely detect a position with a cheap and simple configuration which is easy to assemble, and an image forming apparatus.

The present invention provides a sheet conveying apparatus which detects an end part position of a sheet in a sheet width direction orthogonal to a conveying direction of the sheet conveyed on a sheet conveying path, comprising: a plurality of sensor portions which includes light emitting portions and light receiving portions, and which is arranged in the sheet width direction; a holding portion which holds the plurality of sensor portions such that the sheet conveyed on the sheet conveying path can pass between the light emitting portions and the light receiving portions; a plurality of aperture stops which is disposed between the light emitting portions and the light receiving portions and which is provided on the holding portion; and a driving portion which causes a movement of the holding portion in the sheet width direction.

According to the present invention, when an aperture stop is provided between light emitting portion and a light receiving portion, so that it is possible to precisely detect a position of the end part with a cheap and simple configuration which is easy to assemble.

Further features of the present invention will become apparent from the following description of exemplary embodiments with reference to the attached drawings.

DESCRIPTION OF THE EMBODIMENTS

Hereinafter, an image forming apparatus according to embodiments of the present invention will be described with reference to the drawings. The image forming apparatus according to embodiments of the present invention is a copying machine, printer, facsimile or all-in-one machine of these having a sheet conveying apparatus including a sheet end part detecting portion which can detect an end part position of a sheet. The following embodiments will be described using a laser beam printer 100 as an image forming apparatus.

First Embodiment

Figure 1:
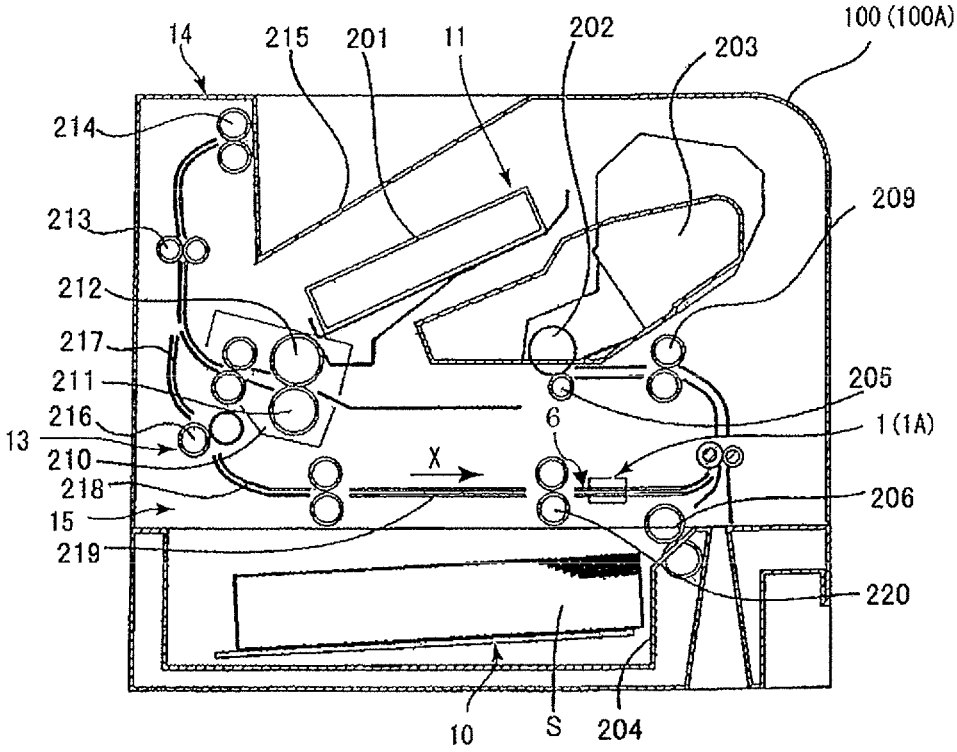
FIG. 1 is a sectional view schematically illustrating the entire structure of a laser beam printer according to a first embodiment of the present invention.

The laser beam printer 100 according to the first embodiment of the present invention will be described with reference to FIGS. 1 to 4. First, the entire structure of the laser beam printer 100 according to the first embodiment will be described with reference to FIG. 1. FIG. 1 is a sectional view schematically illustrating the entire structure of the laser beam printer 100 according to the first embodiment of the present invention.

As illustrated in FIG. 1, the laser beam printer 100 has a sheet feeding portion 10 which feeds sheets S, and an image forming portion 11 which forms images on the sheets S fed from the sheet feeding portion 10. Further, the laser beam printer 100 has a fixing portion 210 which fixes images, a discharge portion 14 and a conveying portion 15 which is a sheet conveying apparatus.

The sheet feeding portion 10 has a sheet cassette 204 which accommodates the sheets S, a pair of feed rollers 206 which feed the sheets S accommodated in the sheet cassette 204 to the image forming portion 11, and a separating portion (not illustrated) which separates the sheet S one by one. The sheet feeding portion 10 feeds the sheets S accommodated in the sheet cassette 204, to the image forming portion 11 by means of a pair of feed rollers 206 while separating the sheets S one by one in the separating portion.

The image forming portion 11 has a pair of conveying rollers 209, an exposure portion 201, a process cartridge 203 and a transfer roller 205. A pair of conveying rollers 209 convey the sheets S fed from the sheet feeding portion 10. The process cartridge 203 has a photosensitive drum 202, a charging portion (not illustrated), a developing portion (not illustrated) and a cleaning portion (not illustrated). The photosensitive drum 202 is formed with a metal cylinder on the surface of which a photosensitive layer of a negative charging polarity is formed. The charging portion evenly charges the drum surface of the photosensitive drum 202 which is an image bearing member. The exposure portion 201 irradiates the photosensitive drum 202 with laser beam based on image information and forms an electrostatic latent image thereon. The developing portion attaches toner to the electrostatic latent image to visualize as a toner image. The transfer roller 205 transfers the toner image on the photosensitive drum 202 to the sheet S. The cleaning portion removes toner left on the surface of the photosensitive drum 202 after toner is transferred.

The fixing portion 210 has a driving roller 211 and a fixing roller 212 in which a heater is built in. The fixing portion 210 fixes to the sheet S the toner image transferred by being heated and pressured against the passing sheets S.

The discharge portion 14 has a pair of inner discharge rollers 213, an outer discharge roller 214 and a discharge tray 215. The discharge portion 14 discharges the sheets S after one face or duplex fixing processing, onto the discharge tray 215 through a pair of inner discharge rollers 213 and the outer discharge roller 214.

The conveying portion 15 has a reversing unit 13 which reverses the two sides of a sheet P1, and a sheet end part detecting portion 1 which is a position detecting apparatus. The reversing unit 13 has a pair of switch-back rollers 216, a re-feeding path 217, a duplex conveying path 218, an intermediate tray 219 and a re-feeding apparatus 220. The reversing unit 13 reverses the two sides of the sheet S after one face fixing processing in duplex printing processing. The sheet S after one face fixing processing is temporarily accommodated on the intermediate tray 219 by being fed through the re-feeding path 217 and duplex conveying path 218 by a pair of inner discharge rollers 213 and a pair of switch-back rollers 216. The sheet S accommodated on the intermediate tray 219 is conveyed to form an image again by the re-feeding apparatus 220, and an image is formed on the second face by the image forming portion. The sheet S on which an image is formed is discharged onto the discharge tray 215 by the discharge portion 14.

The sheet end part detecting portion 1 is provided on the downstream side of the re-feeding apparatus 220. The sheet end part detecting portion detects the end part position on the Y2 side in the sheet width direction Y in which the sheet is misaligned in a direction (the Y direction illustrated in FIG. 2 and hereinafter "sheet width direction Y") orthogonal to the sheet conveying direction (the X direction illustrated in FIG. 2 and hereinafter "conveying direction X").

Figure 2:
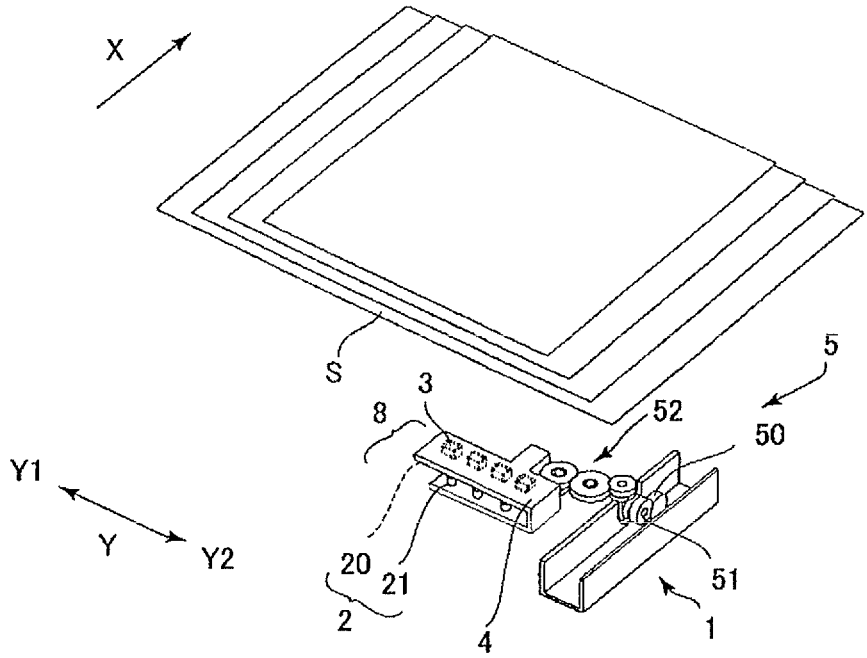
FIG. 2 is a perspective view illustrating a sheet end part detecting portion of a laser beam printer according to the first embodiment.
Figure 3:
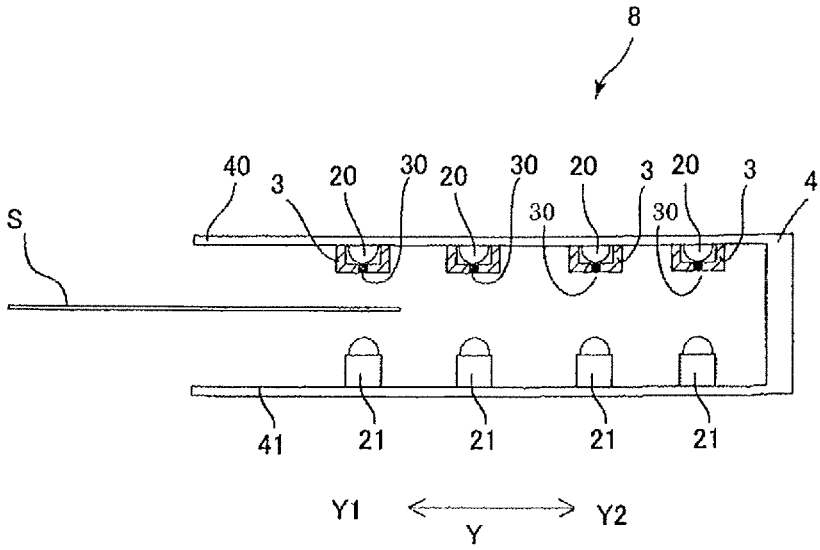
FIG. 3 is a partial enlarged view illustrating a sensor unit of a sheet end part detecting portion according to the first embodiment.
Figure 4:
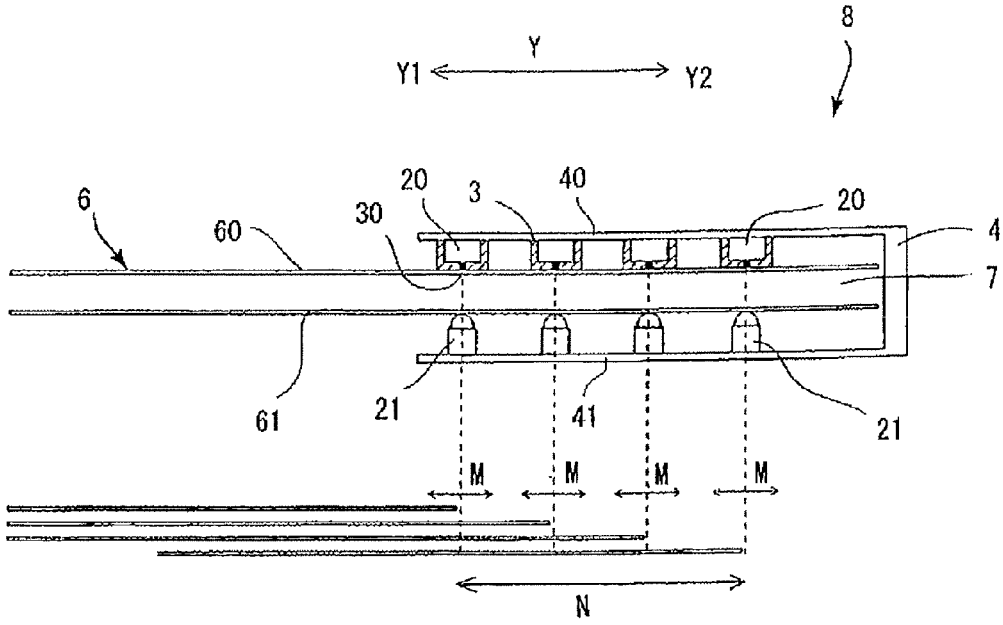
FIG. 4 is a view for describing an operation range of a sheet end part detecting portion according to the first embodiment.

Next, the sheet end part detecting portion 1 will be specifically described with reference to FIGS. 2 to 4. FIG. 2 is a perspective view illustrating the sheet end part detecting portion 1 of the laser beam printer 100 according to the first embodiment. FIG. 3 is a partial enlarged view illustrating the sensor unit 8 of the sheet end part detecting portion 1 according to the first embodiment. FIG. 4 is a view for describing an operation range of the sheet end part detecting portion 1 according to the first embodiment.

As illustrated in FIGS. 2 and 3, the sheet end part detecting portion 1 has a plurality of sensor portions 2, cover members 3 of aperture members, a holder 4 which is a holding portion, a driving unit 5 which is a driving portion, and a pair of conveying guides 6 (see FIG. 1).

The holder 4 is formed such that the cross-section in the sheet width direction Y is formed in a nearly U shape, and an upper surface 40 and lower surface 41 are formed a predetermined interval apart from each other to form the sheet conveying path 7 for the sheets S between the upper surface 40 and lower surface 41. In addition, the upper surface 40 of the holder 4 is a base plate to which a plurality of light emitting elements is attached.

A pair of conveying guides 6 have a first rectangular conveying guide 60 and a second rectangular conveying guide 61. With a pair of conveying guides 6, the first conveying guide 60 is arranged on the upper surface 40 side between the upper surface 40 and lower surface 41 of the holder 4, and the second conveying guide 61 is arranged on the lower surface 41 side in a state where the second conveying guide 61 is spaced a predetermined interval apart from the first conveying guide 60. Thus, a pair of conveying guides 60 form the sheet conveying path 7 on which the sheets S can pass. Further, the first conveying guide 60 and second conveying guide 61 are made of a transparent material.

A plurality of sensor portions 2 is arranged in positions associated with sheet sizes at intervals (predetermined intervals) associated with the sheet sizes in the sheet width direction Y. For example, to support four types of sheet sizes, four sensors are arranged at predetermined intervals associated with each size. Further, as illustrated in FIG. 3, the sensor portion 2 has a light receiving element 20 which is a light receiving portion, and a light emitting element 21 which is a light emitting portion. The light receiving elements 20 are arranged at predetermined intervals in the sheet width direction Y between the upper surface 40 of the holder 4 and the first conveying guide 60. The light emitting elements 21 are arranged to oppose to the light receiving elements 20, between the lower surface 41 of the holder 4 and the second conveying guide 61. That is, the light receiving elements 20 and light emitting elements 21 are each arranged to form pairs. In addition, a plurality of sensor portions 2 is aligned and arranged in the width direction in this way. This arrangement of the sensor portions aligned in the width direction means that the positions of a plurality of sensor portions 2 are different in the width direction, and a plurality of sensor portions 2 is shifted and arranged in the conveying direction.

The cover member 3 is made of a non-permeable material which does not allow transmission of light, and covers the light receiving element 20. The cover member 3 is attached to cover the light receiving element 20, and positioned with respect to the light emitting element 21. A plurality of cover members 3 is individually attached to cover the light receiving elements and positioned, so that the positions of hole portions (aperture stop) 30 formed in the cover members 3 are precise. Further, in the cover member 3, a hole portion 30 is formed in the position meeting the front end of the light receiving element 20 in a state where the cover member 3 covers the light receiving element 20. The hole portion 30 restricts the orientation of light emitted from the light emitting element 21 arranged to oppose to the hole portion 30, and narrows down light such that only the light receiving element 20 arranged to oppose to the hole portion 30 receives light. In other words, the hole portion 30 blocks part of light emitted by the light emitting element 21 arranged to oppose to the hole portion 30, so that the light receiving element 20 arranged to oppose to the hole portion 30 linearly receives light through the hole portion 30 of the cover member 3.

The driving unit 5 causes round trip movement of the holder 4. The driving unit 5 has a stepping motor 50, a pinion 51 attached to the stepping motor 50 and a driving train 52 meshing with the pinion 51. The driving train 52 is coupled to the holder 4, and is formed to move the holder 4 in the sheet width direction Y. The driving unit 5 rotates the stepping motor 50, so that the driving train 52 meshing with the pinion moves the holder 4 in the sheet width direction Y. The end of the driving train 52 is provided with a cam which contacts part of the holder 4, and the holder 4 is moved following rotation of the cam rotated by the stepping motor 50. At this time, as illustrated in FIG. 4, the driving unit 5 causes round trip movement of the holder 4 with a predetermined stroke amount M required to detect an end part position of one sheet size. The cover member 3 positioned with respect to the light receiving element 20 moves together with the holder 4.

Next, the operation of the sheet end part detecting portion 1 will be described with reference to FIG. 4. As illustrated in FIG. 4, the holder (hereinafter, also "sensor unit 8") 4 in which a plurality of sensor portions 2 is arranged detects the light blocking state of the sheets S in a smaller operating area, and therefore the sheet end part detecting portion 1 needs to cause high speed round trip movement of the holder 4. Hence, the driving unit 5 causes round trip movement of the sensor unit 8 of the holder 4 with a predetermined stroke amount M required to detect an end part position of one sheet size.

The round trip movement of this sensor unit 8 causes round trip movement of a plurality of sensor portions 2 fixed and arranged in the sensor unit 8 at the same time. As illustrated in FIG. 4, the distance the sensor unit 8 moves covers a distance N from the maximum size to the minimum size of each sheet conveyed from the image forming portion 11, and one of the light emitting elements 20 is configured to cross the end part of the conveyed sheet S.

Further, the position where the sensor unit 8 makes round trip movement is controlled from the default position where the round trip movement starts such that this position is calculated based on the number of pulses of the stepping motor 50 which drives the holder 4. Consequently, brightness and darkness of light are produced when the sheet S blocks the optical path formed between the light emitting elements 21 and light receiving elements 20, so that the light receiving elements 20 can detect the end part position of the sheet S. At this time, the light receiving elements 20 are covered by the cover members 3, and receive only light incident through the hole portions 30 formed in the cover members 3. The end part position of a sheet is detected based on the distance between the default position of the reference position and the position where the end part of the conveyed sheet is detected by the light emitting elements 21 and light receiving elements 20 (for example, the position where the optical path is blocked by the sheet) during movement of the sensor unit 8.

In a controlling operation, the reference position of the sensor portion 2 outside a sheet conveying area and a default value of a driving pulse of the stepping motor 50 are set. Further, assuming that the average position (average distance) of the end part position (distance) of the sheet S detected a plurality of times while one sheet is conveyed is the end part position of the sheet S (distance to the end part position), a correcting apparatus corrects the exposure position of the image forming portion 11 exposed by the photosensitive drum 202. By this means, it is possible to obtain adequate images without being misaligned in the sheet width direction Y.

When conveyance of the sheet S is finished, the stepping motor 50 is stopped and then the driving train 52 is stopped, and, accompanying this, the sensor unit 8 also stops. At this time, the position of the sensor unit 8 (holder 4 and light receiving elements 20) which is stopped is recognized based on the number of pulses, and is set as the default position to start the following round trip movement of the holder 4.

Next, the method of fitting the light receiving elements 20 and cover members 3 will be described. A plurality of cover members 3 described above is coupled by a coupling member 301. The coupling member 301 is provided with elastic portions 312 which are elastically deformable. The plurality of cover members 3 which is coupled by the coupling member 301 is attached to a transparent supporting plate 302 which is a supporting member. Then, the base plate provided with a plurality of light receiving elements 20 and the supporting plate 302 which supports a plurality of cover members 3 coupled by the elastic portions 312 are assembled to join each other. Further, the elastic portions 312 of a plurality of cover members 3 positioned with respect to the supporting plate 302 deform, and, consequently, the cover members 3 are respectively positioned with respect to the base plate (light receiving elements).

Figure 5:
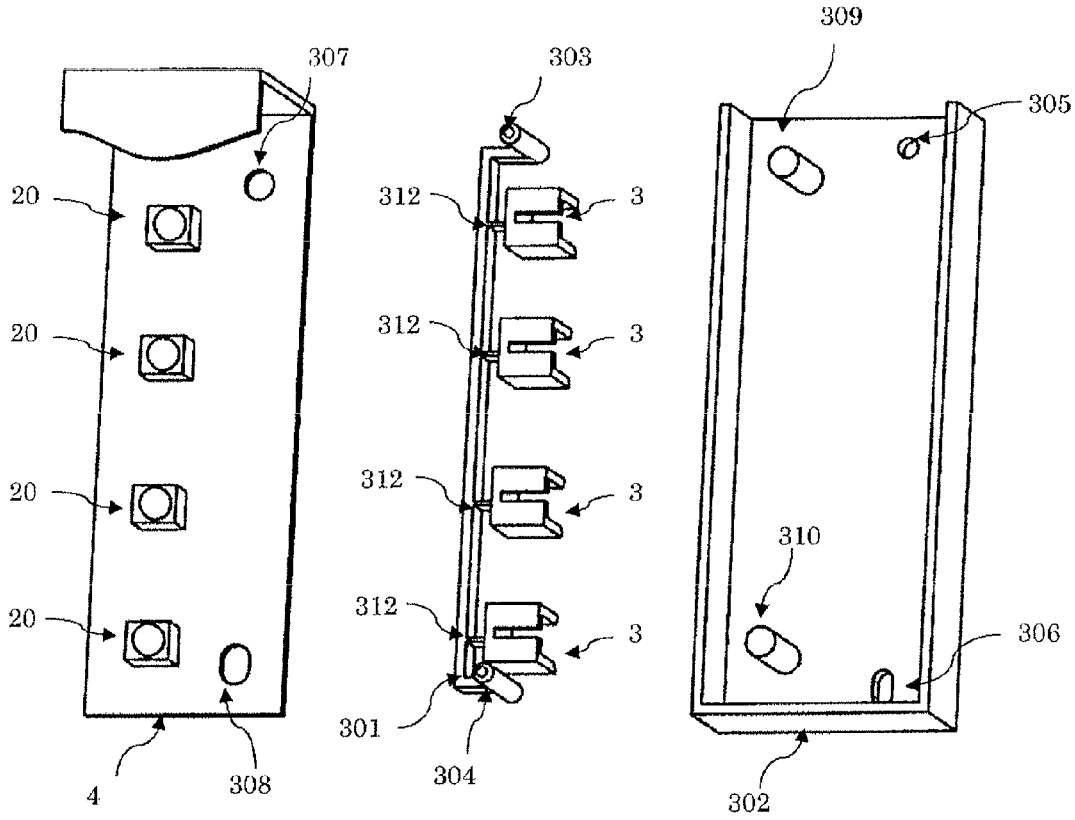
FIG. 5 is an assembly diagram for describing the state before a sensor portion is assembled according to the first embodiment.

Hereinafter, the method of fitting the light receiving elements 20 and cover members 3 will be described in detail with reference to FIGS. 5 to 6B. FIG. 5 is an assembly diagram for describing the state before the sensor portion 2 is assembled according to the first embodiment. FIG. 5 illustrates the state before the cover members 3 are attached to the light receiving elements 20, and illustrates that a plurality of holders 4 and cover members 3 provided with a plurality of light receiving elements 20 are coupled to a coupling member 301 and the supporting plate 302 by the elastic portions 312. In addition, part of a side where the light emitting elements 21 of the holders 4 are provided is not displayed.

Although the elastic portion 312 is made of the same material as the cover member 3, the elastic portion 312 has elasticity by molding the elastic portion 312 thin. In addition, with the present embodiment, as described above, although elasticity is provided by molding the same material thinner, it is also possible to provide the effect of the present invention by molding members other than the cover members 3 using another material and coupling these members.

Positioning portions 303 and 304 which are used to determine the positions with respect to the supporting plate 302 are provided in the coupling member 301. Further, positioning holes 305 and 306 which determine the position of the coupling member 301 are also provided in the supporting plate 302. Further, positioning portions 309 and 310 are provided in the supporting plate 302 such that positioning holes 307 and 308 provided in the holder 4 are positioned.

Figure 6A:
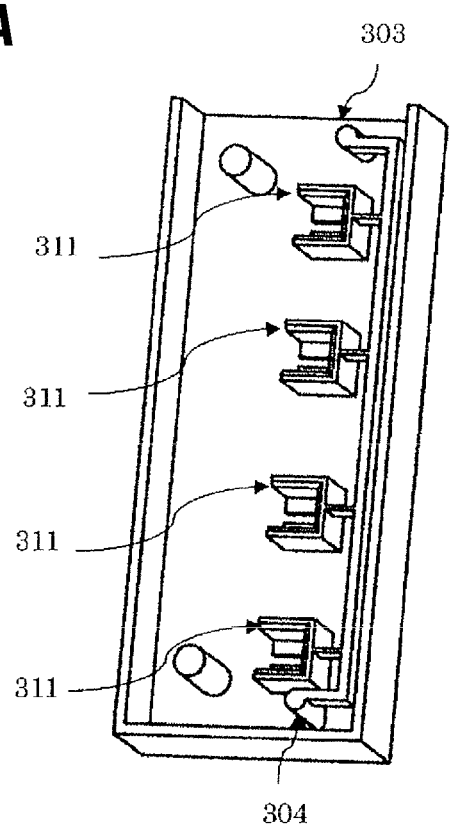
FIG. 6A is a perspective view illustrating the state where cover members and a supporting plate of a sensor portion are assembled according to the first embodiment.

FIG. 6A is a view illustrating that the coupling member 301 is attached to the supporting plate 302. As described above, the positioning portions 303 and 304 of a plurality of aperture members and the positioning holes 305 and 306 provided in the supporting plate mate. Further, a lead-in shape 311 of a chamfered shape is provided such that the light receiving element 20 easily fits in each cover member 3. In addition, the lead-in shape 311 leads the light receiving element 20 in the cover member 3 even if the position variation with respect to the holder 4 of the light receiving element and positioning variation of the transparent member are taken into account.

Figure 6B:
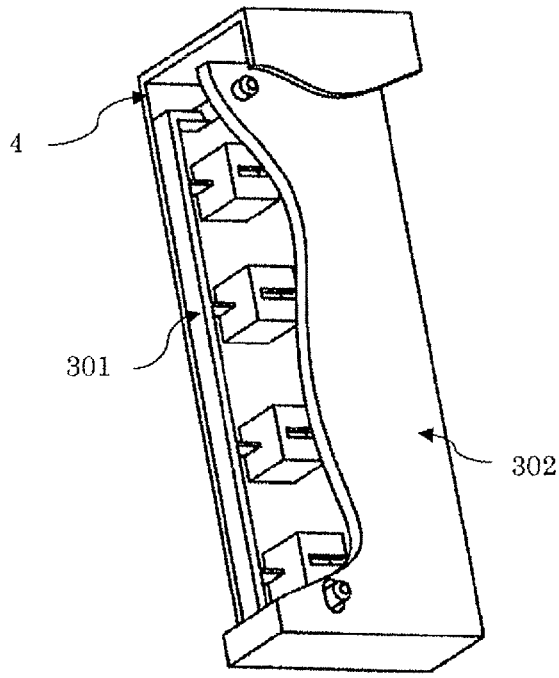
FIG. 6B is a perspective view illustrating the state where a supporting plate and a holder are assembled according to the first embodiment.

FIG. 6B is a view illustrating that the supporting plate 302 is assembled to the holder 4 provided with a plurality of light receiving elements. In addition, FIG. 6B displays the cover members 3 and light receiving elements 20 by making a notch in the supporting plate 302. The positioning holes 307 and 308 of the holder 4 and supporting plate 302 described in FIG. 5 mate, so that arrangement of the supporting plate 302 and holders 4 is determined. At this time, as described in FIG. 6A, the cover member 3 has the lead-in shape 311 of the chamfered shape, and the light receiving element 20 is led in the cover member 3 and is directly positioned.

At this time, the cover members 3 are elastically coupled, and therefore the cover members 3 are not positioned by the supporting plate 302 and are directly positioned with respect to each light receiving element. By so doing, necessary position precision of the cover members 3 and light receiving elements 20 is required and the cover members 3 do not need to be assembled to the light receiving elements 20 one by one. That is, it is possible to substantially improve easiness of assembly. In addition, with the present embodiment, although the number of light emitting elements is four, it is possible to provide the effect of the present invention irrespectively of the number of light emitting elements as long as the number of light emitting elements is plural. A configuration is possible where the whole of coupling member is elastically deformable. A configuration is possible where each of the cover members 3 is positioned by the light receiving element 20 when the supporting plate 302 to which the cover members 3 is attached is combined with the holder 4.

The laser beam printer 100 according to the first embodiment employing the above configuration provides the following effect. The sheet end part detecting portion 1 of the laser beam printer 100 according to the first embodiment detects an end part position of the sheet S by causing round trip movement of a plurality of sensor portions 2. Consequently, it is possible to reduce the number of sensors compared to cases where line sensors associated with sheet sizes are used. By this means, it is possible to reduce cost of sensors, and reduce manufacturing cost of the entire apparatus.

Further, in the sheet end part detecting portion 1 according to the first embodiment, the light receiving elements 20 and light emitting elements 21 are arranged at predetermined intervals in the sheet width direction Y. Further, the light emitting members and light receiving members are configured separately, and respective members are arranged on the upper side and lower side of the sheet conveying path. Consequently, it is not necessary to have the conveyed sheet S stand by in a position where the sheet S does not overlap in the width direction unlike a conventional photointerrupter, or perform control of stopping the sheet S before the end part of the sheet S hits after the end part position of the sheet S is detected. By this means, it is possible to provide a sheet end part detecting portion with a simple configuration.

Further, in the sheet end part detecting portion 1 according to the first embodiment, the cover members 3 are positioned at the positions (outer periphery) of the light receiving elements 20. Consequently, even when, for example, the sheet S floats on the sheet conveying path 7, it is possible to prevent unnecessary light from entering. By this means, it is possible to precisely detect the end part position of a sheet without decreasing reading detection precision. Further, even when the lengths of corresponding sizes in the width direction need to be adjacent and the light emitting elements 21 and light receiving elements 20 need to be arranged adjacently, the direction of emitted light is restricted, so that it is possible to precisely detect the end part position of the sheet S.

For example, with a plurality of light receiving elements and light emitting elements arranged to oppose to each other, there are cases where light emitted by the light emitting elements is diffused and a light emitting element receives light from the adjacent light emitting element to which this light emitting element does not oppose. Particularly when the light receiving elements and light emitting elements make round trip movement and the end part position of a sheet is detected based on the distance between the reference position and the position where the optical path is blocked, the light receiving element is more likely to receive light of the adjacent light emitting element. Therefore, there is a concern that precision to measure the end part position of a sheet decreases. By contrast with this concern, with the present embodiment, the respective light receiving elements 20 are covered by the cover members 3 in which the hole portions 30 are formed. Further, the light receiving element 20 receives only light which has passed the hole portion 30 formed in the cover member 3. By this means, detection precision of the sheet end part detecting portion 1 according to the present embodiment improves.

Further, the sheet end part detecting portion 1 according to the first embodiment detects the end part position of the sheet S by causing round trip movement of a plurality of sensor portions 2 with a simple small stroke. Consequently, the configuration of the driving train 52 becomes simple, and the configuration of the complicated and large moving mechanism is not required. Further, it is possible to detect the end part position of the sheet S a plurality of times while one sheet S passes, so that it is possible to precisely detect the end part position of the sheet S by skewed feeding of the sheet S. Consequently, it is possible to form images of precise positions. As a result, with a cheap and simple configuration, it is possible to provide a sheet end part detecting portion 1 which can precisely detect the position and the laser beam printer 100 having the sheet end part detecting portion 1.

Second Embodiment

Figure 7:
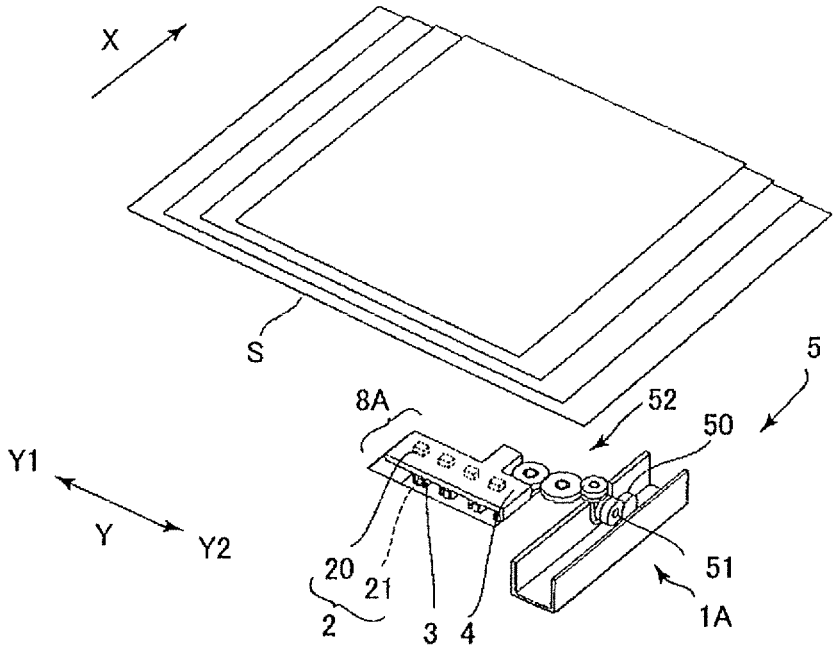
FIG. 7 is a perspective view illustrating a sheet end part detecting portion of a laser beam printer according to a second embodiment.
Figure 8:
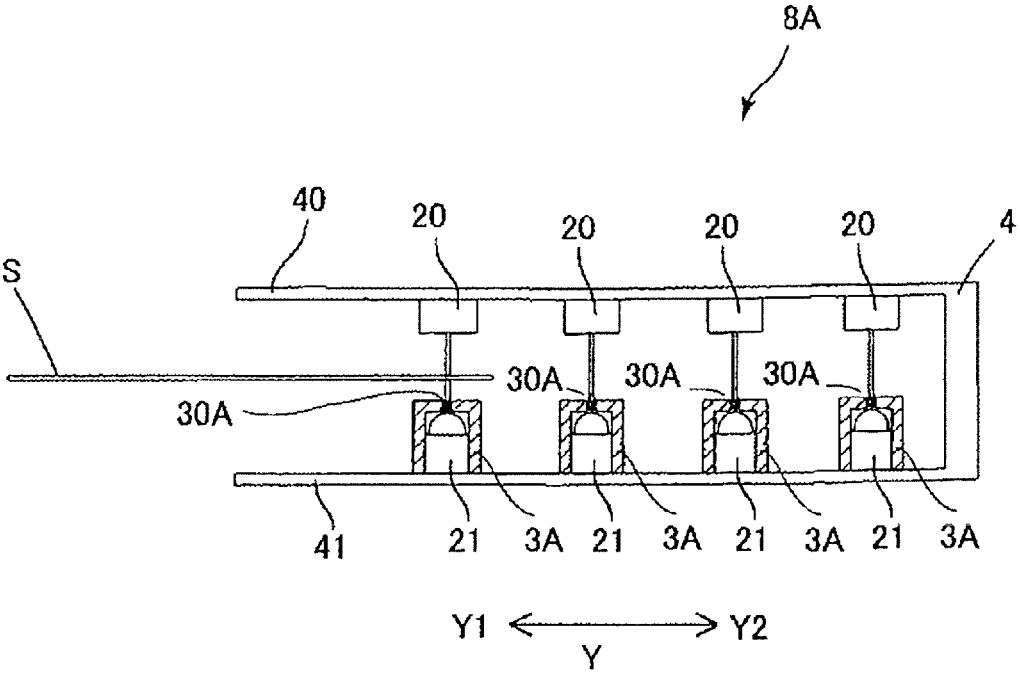
FIG. 8 is a partial enlarged view illustrating a sensor unit of a sheet end part detecting portion according to the second embodiment.
Figure 9:
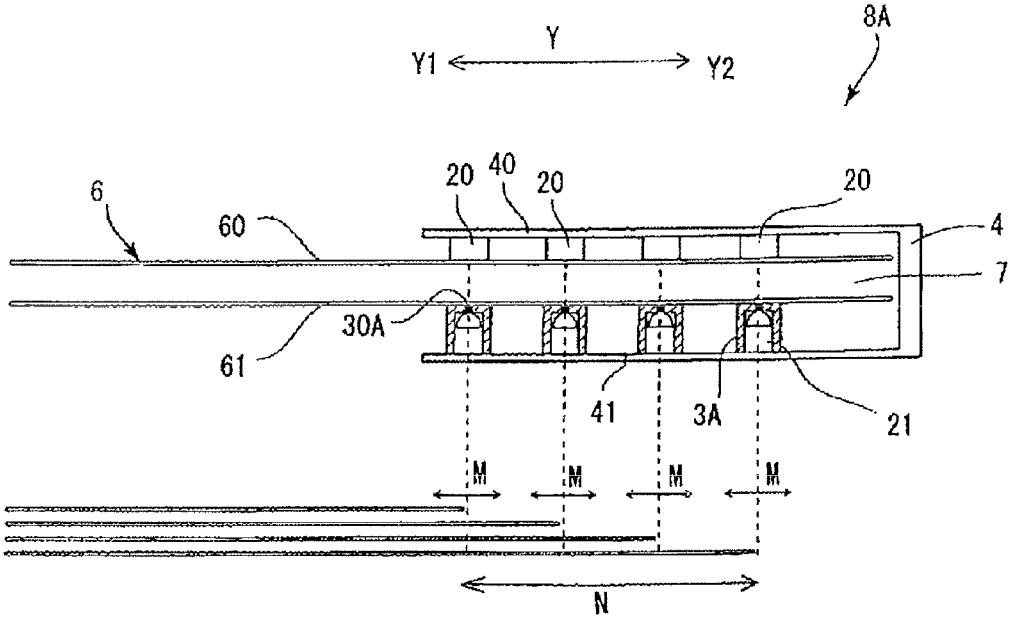
FIG. 9 is a view for describing an operation range of a sheet end part detecting portion according to the second embodiment.

Next, a laser beam printer 100A according to a second embodiment of the present invention will be described with reference to FIGS. 7 to 9 in addition to FIG. 1. FIG. 7 is a perspective view illustrating a sheet end part detecting portion 1A of the laser beam printer 100A according to the second embodiment. FIG. 8 is a partial enlarged view illustrating a sensor unit 8A of the sheet end part detecting portion 1A according to the second embodiment. FIG. 9 is a view for describing an operation range of the sheet end part detecting portion 1A according to the second embodiment.

The laser beam printer 100A according to the second embodiment differs from the laser beam printer 100 according to the first embodiment in covering light emitting elements 21 by means of cover members 3A. Hence, with the second embodiment, the difference from the first embodiment, that is, light emitting elements 21 covered by the cover members 3A, will be mainly described.

In addition, with the second embodiment, the same configuration as the laser beam printer 100 according to the first embodiment will employ the drawings used in the first embodiment and will be assigned the same reference numerals, and description thereof will not be repeated. By this means, with the second embodiment, the same configuration as the first embodiment provides the same effect as the first embodiment.

As illustrated in FIG. 1, the laser beam printer 100A according to the second embodiment has the sheet feeding portion 10 which feeds the sheets S, and the image forming portion 11 which forms images on the sheets S fed from the sheet feeding portion 10. Further, the laser beam printer 100A has the fixing portion 210 which fixes images, the discharge portion 14 and a conveying portion 15A which is a sheet conveying apparatus.

As illustrated in FIG. 7, the conveying portion 15A has a plurality of sensor portions 2, cover members 3A of aperture members, a holder 4 which is the holding portion, the driving unit 5 which is the driving portion and a pair of conveying guides 6 (see FIG. 1).

As illustrated in FIG. 8, the cover member 3A is made of a non-permeable material which does not allow transmission of light, and covers the light emitting element 21. The cover member 3A covers the light emitting element 21 and thereby is positioned with respect to the light receiving element 20. Further, in the cover member 3A, the hole portion 30A is formed in the position meeting the front end of the light emitting element 21 in the state where the cover member 3A covers the light emitting element 21. The hole portion 30A restricts the orientation of light emitted from the light emitting element 21, such that the receiving element 20 arranged to oppose to the hole portion 30A receives light. In other words, the hole portion 30A blocks part of light emitted by the light emitting element 21, so that the light receiving element 20 arranged to oppose to the hole portion 30A linearly receives light through the hole portion 30A of the cover member 3A.

Next, the operation of the sheet end part detecting portion 1A will be described with reference to FIG. 9. As illustrated in FIG. 9, the holder (hereinafter, also "sensor unit 8A") 4 in which a plurality of sensor portions 2 is arranged detects the light blocking state of the sheet S in a smaller operating area, and therefore the sheet end part detecting portion 1A needs to cause high speed round trip movement of the holder 4. Hence, the driving unit 5 causes round trip movement of the sensor unit 8A of the holder 4 with a predetermined stroke amount M required to detect an end part of one sheet size.

The round trip movement of this sensor unit 8A causes round trip movement of a plurality of sensor portions 2 fixed and arranged in the sensor unit 8A at the same time. Here, as illustrated in FIG. 9, the operating area of the sensor unit 8A covers a distance N from the maximum size to the minimum size of each sheet conveyed from the image forming portion 11, and one of the light emitting elements 20 is configured to cross the end part of the conveyed sheet S.

Further, the position where the sensor unit 8A makes round trip movement is controlled from the default position where the round trip movement starts such that this position is calculated based on the number of pulses of the stepping motor 50 which drives the holder 4. Consequently, brightness and darkness of light are produced when the sheet S blocks the optical path formed between the light emitting elements 21 and light receiving elements 20, so that the light receiving elements 20 can detect the end part position of the sheet S. At this time, the light emitting element 21 is covered by the cover member 3A, so that the light receiving element 20 arranged to oppose to the hole portion 30A linearly receives only light incident through the hole portion 30A formed in the cover member 3A. The end part position of a sheet is detected based on the distance between the default position of the reference position and the position where the end part of the conveyed sheet is detected by the light emitting elements 21 and light receiving elements 20 (for example, the position where the optical path is blocked by the sheet) during movement of the sensor unit 8A.

In a controlling operation, the reference position of the sensor portion 2 outside a sheet conveying area and a default value of a driving pulse of the stepping motor 50 are set. Further, assuming that the average position (average distance) of the end part position (distance) of the sheet S detected a plurality of times while one sheet is conveyed is the end part position of the sheet S (distance to the end part position), a correcting apparatus corrects the exposure position of the image forming portion 11 exposed by the photosensitive drum 202. By this means, it is possible to obtain adequate images without being misaligned in the sheet width direction Y.

When conveyance of the sheets S is finished, the stepping motor 50 is stopped and then the driving train 52 is stopped, and, accompanying this, the sensor unit 8A also stops. At this time, the position of the sensor unit 8A (holder 4 and light receiving elements 20) which is stopped is recognized based on the number of pulses, and is set as the default position to start the following round trip movement of the holder 4.

In addition, the light receiving elements 20 are only changed to the light emitting elements 21 in the fitting method described in the first embodiment, and therefore the method of fitting the light emitting elements 21 and cover members 3 according to the second embodiment will not be described.

The laser beam printer 100A according to the second embodiment employing the above configuration provides the following effect in addition to the effect provided from the same configuration as the laser beam printer 100 according to the first embodiment. In the sheet end part detecting portion 1A of the laser beam printer 100A according to the second embodiment, the cover members 3A are positioned in the positions (outer periphery) of the light emitting elements 21. Consequently, even when, for example, the sheet S floats on the sheet conveying path 7, light is linearly radiated from the light emitting elements 21 to the light receiving elements 20, so that it is possible to prevent unnecessary light from entering. By this means, it is possible to precisely detect the end part position of a sheet without decreasing reading detection precision. Further, even when the lengths of corresponding sizes in the width direction are adjacent and the light emitting elements 21 and light receiving elements 20 need to be arranged adjacently, it is possible to precisely detect the end part position of the sheet S.

Although the embodiments of the present invention have been described above, the present invention is by no means limited to the above-described embodiments. Further, the most exemplary effects produced from the present invention have only been described as the effects discussed in the embodiments of the present invention, and the effect of the present invention is by no means limited to the effect discussed in the embodiments of the present invention.

Although a configuration is employed with the present embodiment where the cover members 3 are attached to one of the light receiving elements 20 and light emitting elements 21, the present invention is by no means limited to this. For example, a configuration is possible where the cover members 3 are attached to both of the light receiving elements 20 and light emitting elements 21.

Further, although a configuration has been employed with the present embodiment where the light emitting elements 20 are arranged on the upper surface 40 of the holder 4 and the light emitting elements 21 are arranged on the lower surface 41 of the holder 4, the present invention is by no means limited to this. For example, a configuration is possible where the light receiving elements 20 are arranged on the lower surface 41 of the holder 4 and the light emitting elements 21 are arranged on the upper surface 40 of the holder 4.

Further, although, for example, LEDs can be illustrated as the light emitting elements 21 according to the present embodiment, any light emitting elements are possible as long as the light receiving elements 20 can receive light. Further, although the holder 4 is driven using the stepping motor 50 with the present embodiment, the present invention is by no means limited to this. A configuration is possible where the holder 4 is moved by a driving source other than the stepping motor 50.

Further although, with the present embodiment, an exposure position is corrected as the average position of the end part position of the sheet S obtained by detecting the end part position of the sheet S a plurality of times, the present invention is by no means limited to this. For example, a configuration is possible where control to correct the exposure position of the end part position of the sheet S is performed based on the relationship between the position of the sheet in the conveying direction X upon detection and the end part position of the sheet.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-150246, filed Jun. 30, 2010, No. 2011-071782, filed Mar. 29, 2011 which are hereby incorporated by reference herein in their entirety.

What is claimed is:

1. A sheet conveying apparatus which detects an end part position of a sheet in a sheet width direction orthogonal to a conveying direction of the sheet conveyed on a sheet conveying path, comprising:

a plurality of sensor portions each of which includes a light emitting portion and a light receiving portion, and which are arranged in the sheet width direction;

a holding portion which holds the plurality of sensor portions such that the sheet conveyed on the sheet conveying path can pass between the light emitting portions and the light receiving portions;

a plurality of aperture members each of which has a hole portion through which light passes from the light emitting portion to the light receiving portion, and a plurality of which are provided on the holding portion corresponding with the plurality of the sensor portions;

a driving portion which causes a movement of the holding portion in the sheet width direction; and a coupling member which couples the plurality of aperture members.

2. The sheet conveying apparatus according to claim 1, wherein each the plurality of aperture members is positioned by the light receiving portions or the light emitting portions.

3. The sheet conveying apparatus according to claim 1, wherein the coupling member includes an elastically deformable portion.

4. The sheet conveying apparatus according to claim 1, further comprising a supporting member to which the plurality of aperture members coupled by the coupling member attach, wherein, when the supporting member to which the plurality of aperture members is attached is combined with the holding portion, each of the plurality of aperture members is positioned by the light receiving portions or the light emitting portions.

5. The sheet conveying apparatus according to claim 1, wherein the coupling member is elastically deformable.

6. The sheet conveying apparatus according to claim 1, wherein:

said sheet conveying apparatus is configured to convey a plurality of types of sheets of different sizes in the sheet width direction can be conveyed; and the plurality of sensor portions is arranged in positions associated with sizes of the plurality of types of sheets in the sheet width direction.

7. The sheet conveying apparatus according to claim 1, wherein the driving portion causes round trip movement of the holding portion with a predetermined stroke.

8. The sheet conveying apparatus according to claim 1, wherein a position of an end part of the sheet is detected based on a predetermined reference position and a position where the sensor portion detects the end part of the sheet conveyed during movement of the holding portion.

9. An image forming apparatus comprising:

a sheet conveying path;

an image forming portion which forms an image on a sheet conveyed on the sheet conveying path; and a position detecting apparatus which detects an end part position of a sheet in a sheet width direction orthogonal to a conveying direction of the sheet conveyed on the sheet conveying path, wherein the position detecting apparatus includes:

a plurality of sensor portions each of which includes a light emitting portion and a light receiving portion, and which are arranged in the sheet width direction;

a holding portion which holds the plurality of sensor portions such that the sheet conveyed on the sheet conveying path can pass between the light emitting portion and the light receiving portion;

a plurality of aperture members each of which has a hole portion through which light passes from the light emitting portion to the light receiving portion, and a plurality of which are provided on the holding portion corresponding with the plurality of the sensor portions;

a driving portion which causes a movement of the holding portion in the sheet width direction; and a coupling member which couples the plurality of aperture members.

10. The image forming apparatus according to claim 9, wherein each of the plurality of aperture members is positioned by the light receiving portion or the light emitting portion.

11. The image forming apparatus according to claim 9, wherein the coupling member includes an elastically deformable portion.

12. The image forming apparatus according to claim 9, wherein, when the supporting member to which the plurality of aperture members is attached is combined with the holding portion, each of the plurality of aperture members is positioned by the light receiving portion.

13. The sheet conveying apparatus according to claim 9, further comprising a coupling member which couples the plurality of aperture members, wherein the coupling member is elastically deformable.

14. The image forming apparatus according to claim 9, wherein:

a plurality of types of sheets of different sizes in the width direction can be conveyed; and the plurality of sensor portions is arranged in positions associated with sizes of the plurality of types of sheets in the width direction.

15. The image forming apparatus according to claim 9, wherein the driving portion causes round trip movement of the holding portion with a predetermined stroke.

16. The image forming apparatus according to claim 9, wherein a position of an end part of the sheet is detected based on a predetermined reference position and a position where the sensor portion detects the end part of the sheet conveyed during movement of the holding portion.

17. The image forming apparatus according to claim 9, wherein the image forming portion forms an image on the sheet according to the position of the sheet end part detected by the position detecting apparatus.

18. A sheet conveying apparatus which detects an end part position of a sheet in a sheet width direction orthogonal to a conveying direction of the sheet conveyed on a sheet conveying path, comprising:

a plurality of sensor portions each of which includes a light emitting portion and a light receiving portion, and which is arranged in the sheet width direction;

a holding portion which holds the plurality of sensor portions such that the sheet conveyed on the sheet conveying path can pass between the light emitting portion and the light receiving portion;

a driving portion which moves the holding portion reciprocately in the sheet width direction;

a plurality of aperture members each of which has a hole portion for regulating a direction of passing light by interrupting a part of the passing light, and each of which is disposed between the light emitting portion and the light receiving portion and is positioned according to the light emitting portion and the light receiving portion; and a coupling member which couples the plurality of aperture members.

19. The sheet conveying apparatus according to claim 18, wherein the coupling member is elastically deformable.

20. The sheet conveying apparatus according to claim 18, further comprising a supporting member to which the plurality of aperture members coupled by the coupling member attach, wherein, when the supporting member to which the plurality of aperture members is attached is combined with the holding portion, each of the plurality of aperture members is positioned by the light receiving portion of the light emitting portion.

* * * * *